United States Patent [19]

Turner

[11] Patent Number: 4,902,403

[45] Date of Patent: Feb. 20, 1990

[54] HEAT TREATMENT OF EXCHANGERS TO REMOVE COKE

[75] Inventor: Joe D. Turner, Ashland, Ky.

[73] Assignee: Ashland Oil, Inc., Ashland, Ky.

[21] Appl. No.: 262,182

[22] Filed: Oct. 20, 1988

Related U.S. Application Data

[63] Continuation of Ser. No. 115,782, Oct. 30, 1987, abandoned.

[51] Int. Cl.[4] ..... C10G 9/12; C10G 9/16

[52] U.S. Cl. ..... 208/48 R; 134/2; 134/20; 134/30; 134/39

[58] Field of Search ..... 208/48 R; 134/2, 20, 134/30, 39

[56] References Cited

U.S. PATENT DOCUMENTS

| | | | |
|---|---|---|---|
| 1,470,359 | 10/1923 | Greenstreet | 208/48 R |
| 1,603,541 | 10/1926 | Huff | 208/48 R |
| 1,796,878 | 3/1931 | Watson | 208/48 R |
| 2,057,441 | 10/1936 | McAllister | 208/48 R |
| 2,076,847 | 4/1937 | Johnston | 208/48 R |
| 2,111,717 | 3/1938 | Young | 208/48 R |
| 2,245,554 | 7/1941 | Court | 208/48 R |
| 2,380,391 | 7/1945 | Bates | 208/48 R |
| 2,443,373 | 6/1948 | Borsoff | 208/48 R |
| 2,906,792 | 9/1959 | Kilpatrick | 208/48 R |
| 3,420,711 | 1/1969 | Van Driesen | 134/20 |
| 3,557,241 | 1/1971 | Kivlen et al. | 208/48 R |
| 3,592,762 | 7/1971 | Blaser et al. | 208/48 R |
| 3,732,123 | 5/1973 | Stolfa et al. | 208/48 R |
| 3,764,632 | 10/1973 | Ozawa et al. | 208/48 R |
| 3,880,359 | 4/1975 | Novy | 134/39 |
| 3,920,537 | 11/1975 | Walker | 208/48 R |
| 3,964,976 | 6/1976 | Pettrey, Jr. et al. | 208/48 R |
| 3,996,063 | 12/1976 | Worley et al. | 134/39 |
| 4,022,639 | 5/1977 | Ueki | 208/48 R |

FOREIGN PATENT DOCUMENTS

| | | | |
|---|---|---|---|
| 2645919 | 4/1978 | Fed. Rep. of Germany | 208/48 R |

OTHER PUBLICATIONS

"Chimica Organica", 2nd Italian Ed. by P. Grünanger 1970 Casa Editrice Ambrosiana, pp. 1142–1143.

Derwent Japanese Patents Report, Derwent Publications Ltd., vol. 77, No. 48, 6 Jan. 78, J77046549 & JP.A.51026689 (Kurita Water Ind.) 25 Nov. '77.

*Primary Examiner*—Patrick P. Garvin
*Assistant Examiner*—E. D. Irzinski
*Attorney, Agent, or Firm*—Richard C. Willson, Jr.; Stanley M. Welsh

[57] ABSTRACT

A method for removing furfural-derived coke from metallic surfaces by heating in an oxygen-containing gas, such as air, for a time and at a temperature sufficient to change the crush strength of the furfural coke to a point which will permit easy removal of such coke, without such an evolution of heat that the metallurgical properties of said metal surfaces are undesirably changed.

12 Claims, 3 Drawing Sheets

HEAT TREATMENT OF EXCHANGERS TO REMOVE COKE

This application is a continuation of application Ser. No. 115,782, filed 10/30/87, abandoned.

BACKGROUND OF THE INVENTION

1. Field of the Invention

This invention relates to methods for removing petroleum coke deposits, and specifically, furfural coke. Coke can arise from a high temperature condensation of hydrocarbyl species, i.e. materials containing primarily hydrogen and carbon with minor amounts of heteroatoms such as nitrogen, oxygen, or sulfur. Furfural coke, for purposes of this specification, means hydrogen deficient hydrocarbyl species resulting from decomposition, autoxidation, or polymerization of furfural.

2. Prior Art

On page 181 of *Hydrocarbon Processing* published by Gulf Publishing Company, May, 1978, an article entitled "Problems in Furfural Extraction" discusses problems of coking in lube oil plants. Coke deposits apparently arise due to decomposition, autoxidation or polymerization of furfural. Such furfural decomposition is reported to be inhibited with sodium bicarbonate or tertiary amines which apparently neutralize acids formed during decomposition. An example of a lube oil plant utilizing furfural extractions is reported in the September, 1982, issue of *Hydrocarbon Processing* on page 184. However, regardless of the steps to inhibit coke from furfural decomposition which are presently available, there eventually results such an accumulation of such coke that its removal from the system is required.

Current methods for removing coke have all proven to be too troublesome and time consuming. Scraping with water jets fails because furfural coke has a very high crush strength. Simply scraping or chipping is unsatisfactory because when coke is on the shell side of exchangers, only the outer rows of tubes are accessible. Other methods for cleaning out furfural coke deposits include letting the coke weather in the open for several months, then cleaning with a jet of high pressure water (Texaco's method). This works if the metallic surface is aluminum; it is not known if it will work if the surface is carbon or stainless steel.

Furfural coke deposits are particularly difficult to remove because furfural coke is much harder and clings to metal surfaces more than conventional petroleum coke.

In general, there is no rapid and economically efficient method for removing furfural coke deposits known to the prior art. Conventional methods have been found to be very difficult and inefficient in removing coke deposits. Examples of traditional methods for removing coke deposits are chipping, water jet, steam cutting, and sawing.

Though furfural, as any coke, can be burned, simply burning coke out of a metal heat exchanger is undesirable, because high temperatures from such burning can lead to warping and the introduction of strains and stresses within the metal. Even the physical properties of specially prepared metals such as stainless steel or chrome in the presence of carbon at high temperatures, such as above 800° F. (427° C.), often deteriorate so that they are no longer as corrosion resistant as they would otherwise be had they been properly treated.

The ideal situation is to have a very quick, easy and cost effective method to remove furfural coke deposits. Specifically, it would be desirable to have a method for quickly removing furfural coke from exchangers with blockage ranging from ⅛" to completely plugged. This usually represents roughly two to four years of properly buffered operation.

Accordingly, an object of this invention is to provide a method for removing furfural coke deposits, for example, from heat exchangers in a rapid and efficient manner without deteriorating any metallurgical properties of surfaces from which such coke is removed.

A BRIEF DESCRIPTION OF THE INVENTION

Figure 3:
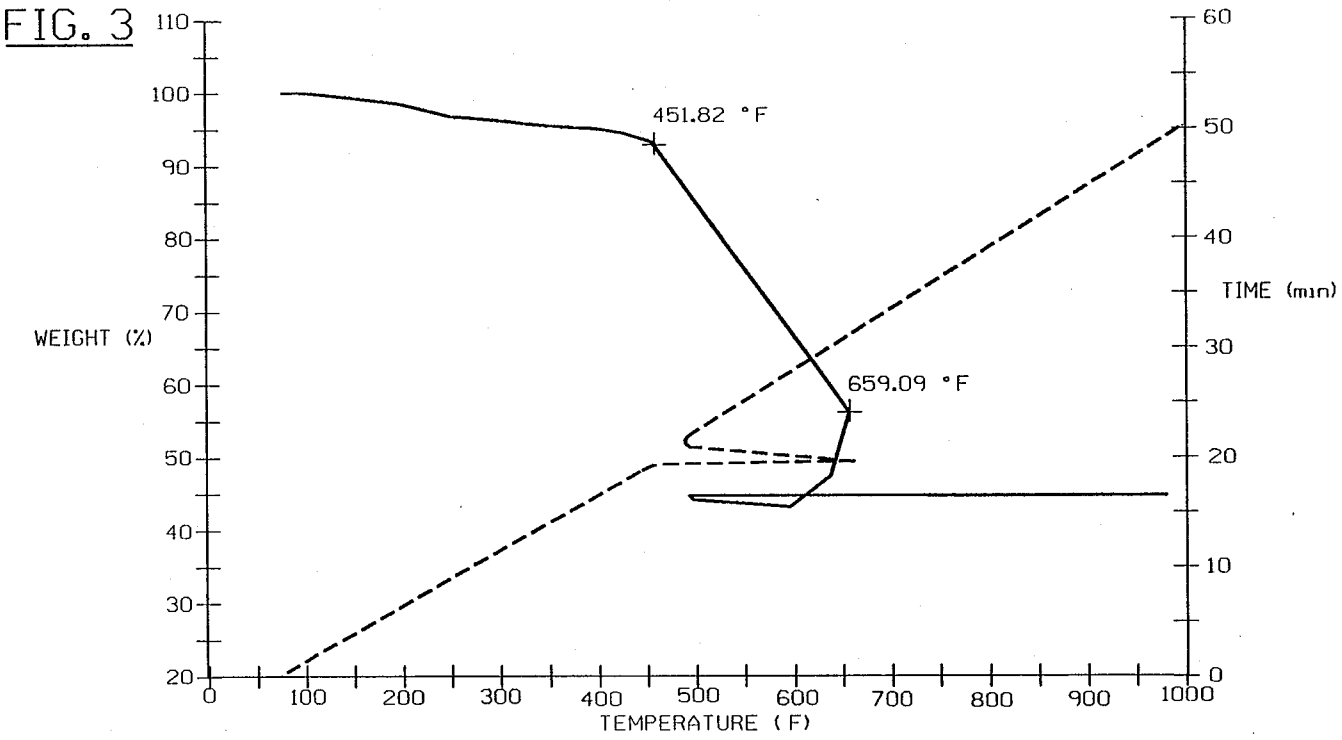

FIG. 3 includes a solid line graph of weight loss of a furfural coke sample as a function of temperature, wherein the sample is heated to increasing temperatures at a constant rate. Temperature of sample as a function of time is shown by dotted line.

Broadly, this invention provides a method for cleaning furfural coke deposits from metal surfaces by means of a unique heat treating process.

We have discovered that, unlike other forms of coke, it is possible to heat furfural coke in the presence of free oxygen at temperatures which do not lead to adverse metallurgical impacts on metallic surfaces, such as in heat exchangers, but yet will cause the character of the coke deposits to change so as to become readily and easily removable. We have discovered, surprisingly, that there exists temperatures in the range of about 400°-800° F. (204°-427° C.), preferably 500°-750° F. (260°-399° C.), and still more preferably 550°-700° F. (288°-371° C.) wherein the crush strength of furfural coke deposits change after being heated in air at a temperature in this range for in excess of at least one hour, preferably in excess of two hours, and generally for a time in the range of about four to six hours. Heating below 800° F. (427° C.) in an inert atmosphere does not result in a change, e.g. a decrease in crush strength, in coke deposits which permit ready removal.

It is possible at these temperatures to heat the coke in air without causing such an excessive amount of heat to be given off that undesirable metallurgic changes occur. When heating in air, we have discovered exotherms occur at roughly 500° F. (260° C.) and 700° F. (371° C.) but do not know precisely what process is causing these exotherms. No exotherms were observed when heating in an inert atmosphere.

Somewhat different temperatures and periods of time are appropriate when heating furfural coke, either in the presence of air at higher than atmospheric pressure or in the presence of higher concentrations of molecular oxygen than present in air to bring about a change in crush strength without giving rise to too rapid or great an evolution of heat. Somewhat lower temperatures and shorter periods of time for heating are required to bring about the same observed decrease in crush strength. Depending upon the concentration of molecular oxygen, the heat treatment can be reduced by as much as a third to a half.

To avoid pockets of furfural trapped within the coke getting out during the heating process and suddenly bursting into flame in the presence of any oxygen in an oven, it is desirable to (1) apply a jet of water under pressure to the tubes, which is ineffective for removing substantial quantities of the coke but does tend to remove most pockets of furfural, or (2) heat in the absence of air or other oxidation-promoting materials, followed by the heating required by this invention. The initial heating in the absence of air can be at any temperature sufficient to vaporize all of the furfural, which would certainly be above its boiling point at the pressures under which the material is being heated, preferably in the range of about 400°-500° F. (204°-260° C.).

Furfural coke forms predominantly in heater systems, high pressure flash distillation sections, and high pressure furfural condenser/heat exchangers. In general, any time you have condensing furfural vapors or when you are vaporizing furfural liquid, there is a tendency for furfural to polymerize and form coke deposits. Furfural coke is a unique type of coke in that it is very difficult to remove, tends not to be particularly porous, and has a very high crush strength determined in accordance with ASTM D-3313 of as much as fourteen pounds. It also contains approximately 30% Carbon and 3% Hydrogen, where the usual petroleum coke contains approximately 80% Carbon and 8% Hydrogen. It is highly resistant to the usual methods of coke removal such as high pressure steam and chipping, cutting or other direct physical methods.

DETAILED DESCRIPTION OF THE INVENTION

Figure 1:
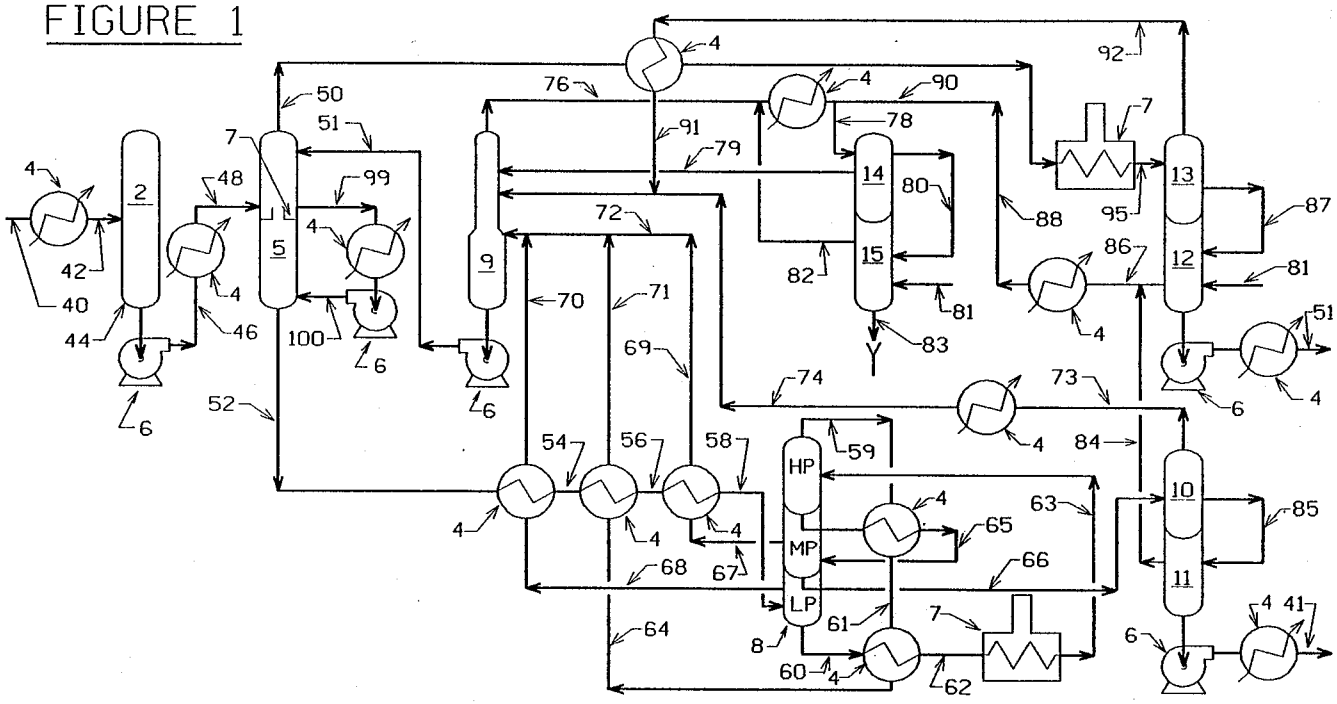
FIG. 1 is a furfural refining unit for preparing lube oils.

In FIG. 1 a furfural refining unit is disclosed in which a waxy distillate is extracted with furfural to yield a refined oil product or raffinate. The elements in FIG. 1 are a deaerator (2), heat exchangers (4), a counter-current extractor (5), pumps (6), three extract flash towers in series (8), a furfural accumulator vessel (9), an extract stripper (10), an extract vacuum flash tower (11), a raffinate stripper (12), a raffinate vacuum flash tower (13), a furfural tower (14), and a water tower (15).

The heat exchangers most prone to have furfural derived carbonaceous (coke) deposits are: those exchangers (4) between lines (52) and (54), (54) and (56), (56) and (58), (60) and (62), (73) and (74), (91) and (92), and hp zone of vessel (8) and line (65) 51, 59, 61, 64, 68, 70, 71, 72, 78, 79, 81, 82, 88, and 90 are all conduits or lines for transferring material.

Briefly, the operation of this system is as follows. An oil charge comprising, for example, 100 neutral or 330 neutral waxy distillate is introduced through conduit (40) and heated by means of a heat exchanger (4) or other heating element and transferred through line (42) to a deaerator (2) to remove any air. Such step is not necessary if the material is previously deaerated and kept under an inert gas such as a nitrogen blanket. The material after being deaerated is transferred from line (44) by pump (6) through line (46) into heating element (4) or a heat exchanger (4) and then through line (48) into a counter-current extractor (5). Through line (51) is introduced substantially pure or recovered furfural. A reflux emptying tray (7) is circulated through lines (99) and (100) by means of a heat exchanger (4) and a pump (6) to improve furfural extraction efficiency in yielding a desirable raffinate product. The raffinate and furfural leave the top of counter-current extractor (5) through line (50), whereas heavier aeromatic material not suitable or desirable for forming lubricating oils leaves through line (52) as an extract mix.

The extract mix goes through a series of process steps to recover the furfural for reintroduction into counter-current extractor (5). The first step of this series involves heating the extract through one or more heat exchangers (4). The heated extract is introduced into the low pressure (lp) zone of flash tower (8), wherein a series of flashes occurs. The lowest pressure is at the lowest temperature and the highest pressure at the highest temperature.

Each flash tower overhead consisting primarily of furfural is removed and sent through different heat exchangers (4).

Bottoms through conduit (60) from the low pressure zone of flash tower (8), comprising furfural and extract, are heated by an exchanger (4) followed by fired heater (7) and transferred through conduit (63) to a high pressure (hp) flash zone of flash tower (8).

Bottoms from high pressure zone are transferred through heat exchanger (4) and conduit (65) to median pressure (mp) zone of flash tower (8).

Bottoms from median pressure zone of flash tower (8) are transferred through line (66) to vacuum flash tower (10).

The overheads (primarily furfural) from the median pressure (mp) flash zone move through line (67) then through exchanger (4) and line (69) to furfural extractor and accumulator (9).

The overheads from the vacuum flash tower (10), comprising primarily furfural, are transferred through line (73) to heat exchanger (4) and then through line (74) to vessel (9) for reuse in the counter-current extractor (5). Bottoms from extract vacuum flash zone (10) are transferred through conduit (85) to the extract stripping zone (11).

Into stripping zone (11) steam is introduced to strip out furfural from the extract which leaves vessel (11) through a pump (6), a heat exchanger (4), and line (41) to an appropriate storage zone not shown.

Stripped material from vessel (11) exits through line (84) for further stripping in a two tower azeotrope stripping section, which consists of an accumulator (14), a furfural tower (9) and water tower (15).

The stripped material from vessel (11) enters the accumulator (14). A furfural rich stream is drawn through line (79) to the furfural tower (9) where it is stripped with furfural vapors. The overhead of the furfural tower is a furfural—water azeotrope and exits through line (76) where it combines with the overhead of the water tower (also a furfural—water azeotrape). The combined stream flows through exchanger (4) back to accumulator (14). Substantially pure furfural exits through the bottom of the furfural tower (9), where it is recirculated back to the contactor (5). A second stream (water rich) is drawn from the accumulator (14) through line (80) into the water tower where it is stream stripped. The overhead being a furfural-water azeotrope combines with the overhead of the furfural tower as was stated earlier. Substantially pure water exits through conduit (83) for reuse or discard.

The raffinate and furfural in line (50) first exchanges heat in a heat exchanger (4) with furfural overhead in line (92) from raffinate vacuum flash tower (13). The overhead in line (50) after heat exchange is further heated in fired heater (7) prior to transfer in line (95) to raffinate vacuum flash tower (13), where most of the furfural is flashed overhead through conduit (92). Bottoms are routed through conduit (87) to the raffinate stripper (12). In stripper (12), steam is used to strip out any remaining furfural from the raffinate. The overhead conduit (86) combines with that of the extract stripper

(11) and enters azeotrope stripping section (14). The bottoms (refined oil) is cooled then sent to storage for further processing.

EXAMPLE

Figure 2:
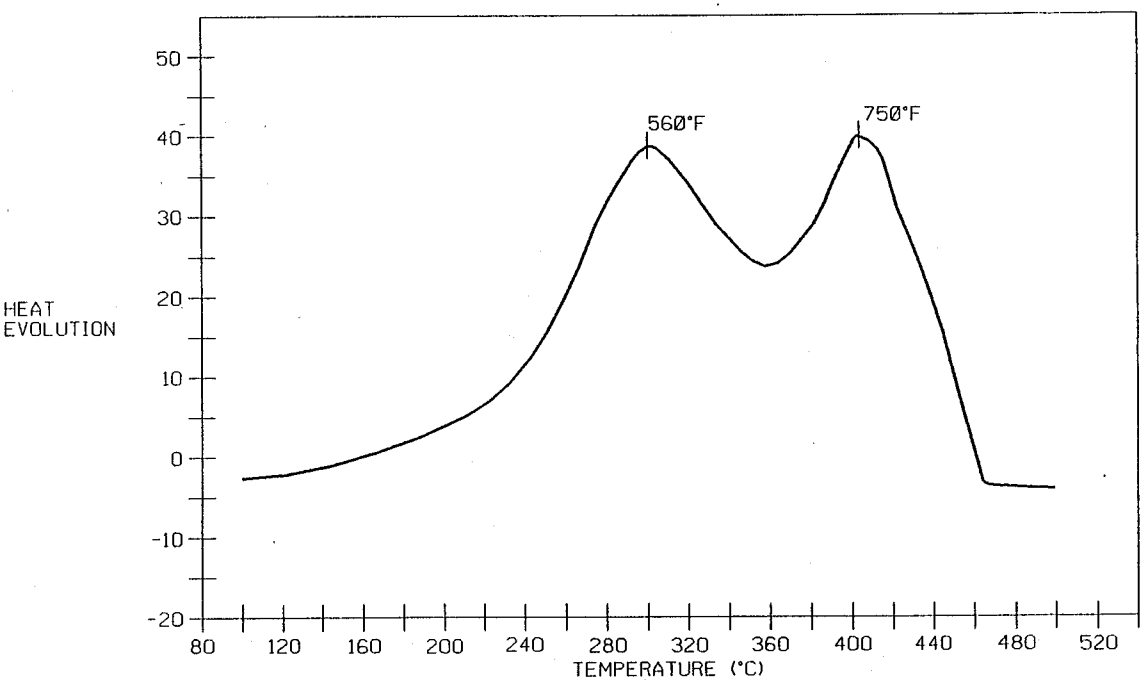
FIG. 2 is the observed heat evolution at various temperatures when heating furfural coke.

Furfural-derived coke found in certain heat exchangers discussed herein before, were heated at increasing temperatures in the presence of air. In FIG. 2, a graph of heat evolution versus temperature reveals two exotherms at roughly 560° F. (239° C.) and 750° F. (399° C.).

In FIG. 3, the solid line shows a rapid weight loss in a sample of furfural coke, beginning at around 452° F. and ending at around 660° F. This occurred while heating the sample at a constant rate (see broken line).

The furfural coke tested had an initial crush strength of fourteen pounds as determined in accordance with ASTM D-3313. The final crush strength after heat treating was so low it did not register on our instruments, i.e. less than one pound.

A water jet typically emits water at a pressure of four to five thousand pounds per square inch (4,000 to 5,000 psi). We have found that prior to heat treatment of furfural derived coke in accordance with this invention, a water jet of five thousand pounds per square inch was insufficient to remove such coke deposits. Even water jets as high as thirty thousand pounds per square inch could not completely remove coke deposits.

However, after heat treating in accordance with this invention, a water jet of 5,000 psi easily removed all coke deposits. A water jet of as little as 1,000 psi worked. In fact, the nature of the coke had so changed that small vibrations such as from transporting a heat exchanger in a truck resulted in removal of most of the coke deposits. The crush strength had decreased from fourteen pounds to less than one pound, as measured in accordance with ASTM D-3313.

Examples of commercially available water jets that can be used in this invention are: a Partek® Liqua-Blaster model 610 DST and Jetpac TM, model 1003, sold by Adnrac, Inc. of Washington.

Specific compositions, methods, or embodiments discussed herein are intended to be only illustrative of the invention disclosed by this Specification. Variations on these compositions, methods, or embodiments, such as combinations of features from various embodiments, are readily apparent to a person of skill in the art based upon the teachings of this Specification and are therefore intended to be included as part of the inventions disclosed herein. Any reference to literature articles or patents made in the Specification is intended to result in such articles and patents being expressly incorporated herein by reference including any articles or patents or other literature references cited within such articles or patents.

The invention which is claimed is:

1. A process for preparing furfural coke for removal from metallic surfaces comprising: heating said furfural coke without causing an evolution of heat capable of undesirably altering metallurgical properties of said surfaces in the presence of a gas containing molecular oxygen at a sufficient temperature below 800° F. (427° C.) for a sufficient time to change the crush strength of the coke so as to permit removal with a water jet at a pressure of five thousand pounds per square inch.

2. The process of claim one, wherein volatiles in said furfural coke are removed prior to said heating in the presence of molecular oxygen.

3. The process of claim two, wherein volatiles are removed by heating in an inert atmosphere.

4. The process of claim one, wherein said heating in the presence of molecular oxygen, is at a temperature in the range of about 400° to 800° F. (204°–427° C.).

5. The process of claim 1, wherein said heating in the presence of molecular oxygen, is at a temperature in the range of about 400° to 800° F. (204°–427° C.).

6. The process of claim 2, wherein said heating in the presence of molecular oxygen, is at a temperature in the range of about 400° to 800° F. (204°–427° C.).

7. The process of claim one, wherein said heating in the presence of molecular oxygen, is at a temperature in the range of about 550° to 700° F. (288°–371° C.).

8. The process of claim four, wherein said heating in the presence of molecular oxygen, is at a temperature in the range of about 550° to 700° F. (288°–371° C.).

9. The process of claim three, wherein said heating in the presence of molecular oxygen, is at a temperature in the range of about 550° to 700° F. (288°–371° C.).

10. A process for preparing furfural coke for removal from a metallic surface comprising:

A. Removing volatiles without igniting them;

B. Heating in the presence of molecular oxygen at a temperature and for a time sufficient to change the crush strength of the coke so as to permit easier removal of such coke than would otherwise be the case without damaging metallurgical properties of said metallic surface becauseof high evolution of heat.

11. The process of claim ten, wherein said heating is at a temperature in the range of about 400° F. to 800° F. (204° C. to 427° C.).

12. The process of claim 11, wherein said heating is for at least one hour.

* * * * *